US005378328A

United States Patent [19]

Baltazar et al.

[11] Patent Number: 5,378,328

[45] Date of Patent: Jan. 3, 1995

[54] PROCESS FOR THE ELECTROCHEMICAL RECOVERY OF BISMUTH FROM AN ION EXCHANGE ELUENT

[75] Inventors: Varujan Baltazar, Montreal; John L. Cromwell, Pincourt, both of Canada

[73] Assignee: Noranda Inc., Toronto, Canada

[21] Appl. No.: 102,173

[22] Filed: Aug. 4, 1993

[30] Foreign Application Priority Data

Dec. 16, 1992 [CA] Canada ..... 2081292

[51] Int. Cl.[6] ..... C25C 1/22

[52] U.S. Cl. ..... 204/105 R; 205/232; 205/261; 423/87

[58] Field of Search ..... 204/105 R, 149; 423/87; 205/315, 232, 261

[56] References Cited

U.S. PATENT DOCUMENTS

| | | | |
|---|---|---|---|
| 1,194,438 | 8/1916 | Stevens | 205/261 |
| 3,491,003 | 1/1970 | Baltisberger | 205/261 |
| 4,026,776 | 5/1977 | Hirakawa et al. | 204/117 |
| 5,071,819 | 12/1991 | Tarbet et al. | 502/401 |
| 5,084,430 | 1/1992 | Tarbet et al. | 502/401 |

FOREIGN PATENT DOCUMENTS

| | | | |
|---|---|---|---|
| 22251 | 8/1896 | United Kingdom | 204/105 R |

OTHER PUBLICATIONS

Walker et al., "The Electrodeposition of Bismuth" in Metal Finishing Jun. 1980 pp. 79–83.

*Primary Examiner*—John Niebling
*Assistant Examiner*—Arun S. Phasge
*Attorney, Agent, or Firm*—Keck, Mahin & Cate

[57] ABSTRACT

A process is provided for the recovery of bismuth from an ion exchange eluent solution consisting of at least 50% sulfuric acid maintained at a temperature of 95°–100° C. The process comprises the step of electrowinning bismuth from the sulfuric acid solution in an electrochemical cell at a current density up to 30 A/m$^2$ using an insoluble anode and a cathode that is impervious to the highly corrosive environment of hot sulfuric acid, for a time interval such as to reduce the bismuth content of the solution down to about 3–5 g/L.

7 Claims, 1 Drawing Sheet

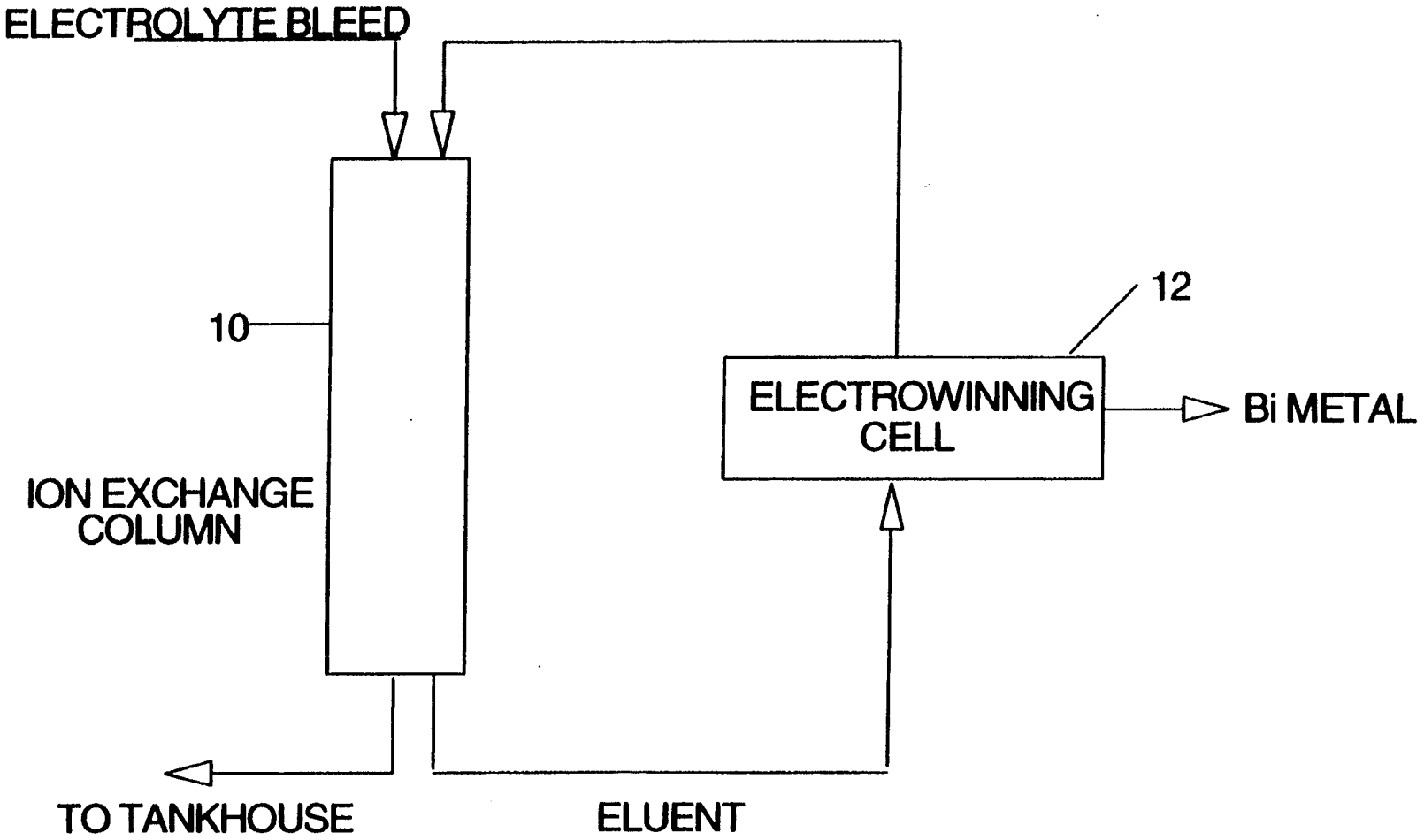
ELECTROLYTE BLEED
10
ION EXCHANGE COLUMN
TO TANKHOUSE
ELUENT
ELECTROWINNING CELL
12
Bi METAL

PROCESS FOR THE ELECTROCHEMICAL RECOVERY OF BISMUTH FROM AN ION EXCHANGE ELUENT

This invention relates to a process for the recovery of metallic bismuth from the strip liquor of an ion exchange eluent.

BACKGROUND OF INVENTION

Bismuth is one of the most deleterious impurities affecting the quality of electrorefined copper. For the production of good quality copper acceptable by rod mills, the bismuth concentration should not exceed 0.2–0.3 ppm. However, with the depletion of cleaner copper orebodies around the globe, more and more smelters are now being forced to accept and treat dirtier feed materials including high concentrations of bismuth. The smelting of high bismuth containing feed materials results in most cases in the production of copper anodes having high bismuth concentrations, and puts pressure on the electrorefining operations.

During the electrorefining of copper anodes which is conventionally carried out in a sulfuric acid/copper sulfate solution, impurities either dissolve in the electrolyte, or precipitate in the slime layer. Bismuth, arsenic and antimony present in the anode report both to the slime and electrolyte phases in proportions which may to some extent depend on other impurities in the anodes as well as their respective concentrations. Once in the electrolyte, the bismuth can contaminate the cathode via different mechanisms. For example, if the electrolyte bismuth level is left to reach its saturation level which is only 0.3–0.4 g/L, bismuth oxides can precipitate and contaminate the copper deposit on the cathode. Also, bismuth contamination of the cathodes may occur by complex precipitates (float slimes) formed with other impurities in the electrolyte or simply by the occlusion of the electrolyte in the copper deposit. In conventional copper electrorefining process a major part of the bismuth is removed during an electrolytic purification process whereby a bleed of tankhouse electrolyte is treated in electrowinning cells. Here, after initial decopperization bismuth is deposited onto a cathode along with other impurities such as arsenic and antimony to form a sludge.

When the bismuth input to the refinery is high, the electrolytic purification which is limited to the amount of dissolved copper in the electrolyte cannot maintain the bismuth concentration at a comfortably low level. Higher bismuth levels result in cathodes contaminated with high levels of bismuth and renders the product unacceptable for copper rod plants.

To help remove additional quantities of bismuth from copper electrolyte, some refineries have developed ion exchange purification systems. For example, in the Tamano process, the ion exchange resin removes both antimony and bismuth from electrolyte. The stripping of the loaded resin is carried out with concentrated hydrochloric acid which is recovered by distillation. The recovered hydrochloric acid is returned to stripping while both the antimony and bismuth are recovered as a sludge and further treated. The high concentrations of chloride ions in the electrolyte promote the precipitation of a cuprous chloride (CuCl) layer on the anodes causing them to passivate. Another disadvantage of the system is the very cumbersome distillation process which requires expensive equipment. Due to these inconveniences some refineries reportedly neutralize the hydrochloric acid with lime. This, on the other hand requires a costly neutralization process and the treatment or the disposal of the bismuth and antimony containing sludge. In another development, crown ethers are used to selectively remove bismuth from tankhouse electrolyte. The advantage of this process is that the loaded particles can be stripped by sulfuric acid rather then hydrochloric acid to yield a strip solution with a relatively concentrated bismuth level (up to 10 g/L). The use of sulfuric acid eliminates the potential hazard of concentrated hydrochloric acid solution accidentally entering the tankhouse which would have a devastating effect onto the electrolysis itself. However, the conventional way of treating this eluent is to neutralize it and produce a bismuth containing sludge for disposal or sending it back to a smelter. In the latter case some of the bismuth will find its way back into the metal refined during the smelting operations.

SUMMARY OF THE INVENTION

It is the object of the present invention to provide a process which permits the recycle of the strip liquor for restripping of the ion exchange bed in an environmentally friendly closed loop with no further requirements for additional effluent treatment. The metallic bismuth produced can be sold as is or refined further by conventional techniques to produce high purity metal for specific applications.

The process in accordance with the present invention consists of electrowinning the bismuth contained in an ion exchange eluent consisting of at least 50% sulfuric acid maintained at a temperature of 95°–100° C. Bismuth is electrowon at a current density up to 30 A/m$^2$ using an insoluble anode and a cathode that is impervious to the highly corrosive environment of hot sulfuric acid, for a time interval such as to reduce the bismuth content of the solution down to 3–5 g/L.

Once the bismuth is removed to a level of 3–5 g/L, the eluent solution is refurbished with bismuth to the original level (usually about 10 g/L) by restripping the leached resin and the electrolysis repeated several times to build up a thick deposit of bismuth. The cathode is then removed from the electrochemical cell and the bismuth deposit stripped from the cathode. The cathode is preferably placed in an oven at a temperature of about 350° C. resulting in the melting of the bismuth. The cathode can be replaced in the electrochemical cell and the electrolysis continued to extract a further quantity of bismuth.

The anode is preferably made of platinized metal such as platinized niobium or titanium. The cathode is preferably made of Hastelloy B2 (trade name of Atlas Steels, Welland, Ontario) or graphite.

The current efficiency of the above process is normally higher than 55% provided that the antimony content of the ion exchange eluent is lower than 0.9 g/L.

BRIEF DESCRIPTION OF THE DRAWING

The invention will now be disclosed, by way of example, with reference to a drawing which illustrates a diagram of the process in accordance with the invention.

DETAILED DESCRIPTION OF THE INVENTION

As shown in the drawing, the electrolyte from a copper refining tankhouse is sent to an ion exchange column 10 where Bi is absorbed. In the present example, the ion exchange is made of crown ether molecules (such as the Superlig molecules of IBC Advanced Technologies) that can selectively recover the bismuth from the tankhouse electrolyte. The ion exchange column is stripped with concentrated sulfuric acid maintained at a temperature in the range of 95°-100° C. The resulting eluent can contain up to 10 g/L Bi. However, other ion-exchange processes using a sulfuric acid eluent could be used.

In the present invention, the hot (95°-100° C.) and concentrated (800 g/L) sulfuric acid is sent to an electrochemical cell 12 for electrowinning the Bi and recycling the spent acid back to the stripping process. This provides a closed loop system with no effluent and the production of a saleable bismuth metal is achieved.

The electrowinning process uses a cell which is characterized by a cathode and an anode. In this process the bismuth containing eluent can be treated either in a batch or continuous mode in this cell. The bismuth is plated on the cathode surface while oxygen gas is evolved at the anode. Due to the very aggressive nature of the electrolyte the electrode materials should be chosen very carefully. A number of materials have been used as anodes for the electrolysis, including lead, lead-Sb, lead-Ag and platinized metal. Lead and lead alloys are found to corrode and contaminate the bismuth product. The most suitable material to be used as an anode was found to be a platinized metal, such as platinized niobium or titanium. A number of materials have been used as cathodes for the electrolysis, including stainless steel, titanium, motel metal, copper, aluminum and Hastelloy B2. Others would include zirconium and carbon. With the exception of Zr, Hastelloy B2 and graphite, the electrolyte was contaminated by dissolution of the cathode materials, even under the umbrella of cathodic protection.

During this invention, it was found that the bismuth can be plated at relatively high efficiencies (50-80%) down to 3-5 g/L Bi in the eluent, despite the competing reaction of hydrogen evolution at the cathode. The process poses no environmental hazard because bismuthine is an unstable gas and cannot be detected during the electrowinning process. The bismuth can be recovered by simply heating the cathode at around 350° C. The cathode is sent back to electrowinning operation. The purity of bismuth recovered is in most cases 99.9% and over which can be sold as is.

The invention will now be disclosed with reference to several examples wherein bismuth is recovered from an ion-exchange eluent similar to one originating from a process developed by IBC Advanced Technologies.

Bismuth was recovered from the aforementioned solution by electrowinning using an insoluble anode made of platinized niobium and a cathode made of Hastelloy B2. Bismuth was present in the electrolyte at an initial concentration of ~10 g/L and sulfuric acid at a concentration of 800 g/L. An electrolyte temperature of 95°-100° C. was necessary to maintain the solubility of the bismuth in the electrolyte during electrowinning, preventing precipitation of bismuth as the sulfate.

Bismuth was electrodeposited for periods of up to 14 days at current densities of up to 30 A/m$^2$, after which the deposit was manually stripped, from the cathode, with the assistance of insulating edge strips preventing total enveloping deposition. The electrodeposited bismuth was relatively smooth and coherent, however, very brittle as is the nature of bismuth. Another distinct and better possibility for bismuth recovery and for ease of that recovery was that, since bismuth is a low melting metal(~281° C.), the cathode could be placed in an oven at 350° C., the bismuth deposit liquefied and the cathode returned to the electrolyte.

| | |
|---|---|
| Example 1 | |
| Sulfuric acid | 800 g/L |
| Bismuth | 10 g/L |
| Antimony | 0 |
| Electrolyte temperature | 95-100° C. |
| Cathode current density | 11 A/m$^2$ |
| Current efficiency | 80% |
| Example 2 | |
| Sulfuric acid | 800 g/L |
| Bismuth | 10 g/L |
| Antimony | 0.3 g/L |
| Electrolyte temperature | 95-100° C. |
| Cathode current density | 11 A/m$^2$ |
| Current efficiency | 75% |
| Example 3 | |
| Sulfuric acid | 800 g/L |
| Bismuth | 10 g/L |
| Antimony | 0.3 g/L |
| Electrolyte temperature | 95-100° C. |
| Cathode current density | 11 A/m$^2$ |
| Current efficiency | 55% |

The bismuth was removed from the electrolyte to a concentration of ~4g/L lower removal values could promote the incidence of stibine generation), refurbished and the electrolysis repeated. The cathode efficiency tended to decrease with the increase in antimony concentration. As well, the electrodeposits appeared to darken with an increase in Sb to 0.9 g/L.

| | |
|---|---|
| Example 4 | |
| Sulfuric acid | 800 g/L |
| Bismuth | 10 g/L |
| Antimony | 0.3 g/L |
| Electrolyte temperature | 95-100° C. |
| Cathode current density | 11 A/m$^2$ |
| Current efficiency | 75% |

The bismuth was removed from the electrolyte, by electrolysis, to a level of ~4g/L, refurbished with bismuth to the original level of ~10g/L and the electrolysis repeated several times to build up a thick deposit of bismuth. The cathode used in this case was either Hastelloy B2 or graphite. The cathode, with its bismuth deposit, was placed in an oven at a temperature of 350° C. resulting in the melting of the bismuth and its collection in a container placed under the electrode. The electrode, divested of its layer of bismuth, was then replaced in the electrolyte and the electrolysis continued to extract a further quantity of bismuth.

We claim:

1. A process for the recovery of bismuth from an ion exchange eluent solution consisting of at least 50% sulfuric acid maintained at a temperature of 95°-100° C., comprising the step of electrowinning bismuth from the sulfuric acid solution in an electrochemical cell at a current density up to 30 A/m$^2$ using an insoluble anode and a cathode that is impervious to the highly corrosive environment of hot sulfuric acid, for a time, interval such as to reduce the bismuth content of the solution down to about 3–5 g/l.

2. A process as defined in claim 1, wherein the bismuth deposit is manually stripped from the cathode.

3. A process as defined in claim 1, wherein the bismuth deposit is removed from the cathode by heating the cathode at around 350° C.

4. A process as defined in claim 1, wherein the anode is made from a material selected from lead, lead-Sb, lead-Ag and platinized metal.

5. A process as defined in claim 4 wherein the platinized metal is niobium or titanium.

6. A process as defined in claim 1, wherein the cathode is made from a material selected from Zr, Hastelloy 2b and carbon.

7. A process as defined in claim 1, wherein the ion exchange eluent solution contains less than 0.9 g/l antimony.

* * * * *